US011292272B2

(12) United States Patent
Washio

(10) Patent No.: US 11,292,272 B2
(45) Date of Patent: Apr. 5, 2022

(54) DRYING DEVICE AND PRINTING DEVICE

(71) Applicant: SEIKO EPSON CORPORATION, Tokyo (JP)

(72) Inventor: Yuichi Washio, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 263 days.

(21) Appl. No.: 16/670,660

(22) Filed: Oct. 31, 2019

(65) Prior Publication Data

US 2020/0130379 A1 Apr. 30, 2020

(30) Foreign Application Priority Data

Oct. 31, 2018 (JP) ..... JP2018-205450

(51) Int. Cl.

| | |
|---|---|
| ***B41J 11/00*** | (2006.01) |
| ***F26B 3/30*** | (2006.01) |
| ***F26B 13/10*** | (2006.01) |
| ***B65H 29/24*** | (2006.01) |

(52) U.S. Cl.

CPC ..... *B41J 11/00216* (2021.01); *B65H 29/245* (2013.01); *F26B 3/30* (2013.01); *B41J 11/0022* (2021.01); *B65H 2301/4461* (2013.01)

(58) Field of Classification Search

CPC ..... B41J 11/00218; B41J 11/0022; B41F 23/0413; B41F 23/0456; B41F 23/042; B41F 23/0459; H05B 3/16; H05B 3/32; H05B 3/748

See application file for complete search history.

(56) References Cited

U.S. PATENT DOCUMENTS

| | | | | |
|---|---|---|---|---|
| 3,571,566 A * | 3/1971 | Kuzara | ..... | H05B 3/16 219/536 |
| 3,649,808 A * | 3/1972 | Garbe | ..... | G03G 15/2007 219/216 |
| 3,939,326 A * | 2/1976 | Hutner | ..... | G03G 15/2007 219/216 |
| 3,989,926 A * | 11/1976 | Yoshizawa | ..... | G03G 15/2007 219/216 |
| 2012/0154498 A1 | 6/2012 | Chiwata | | |

FOREIGN PATENT DOCUMENTS

| | | |
|---|---|---|
| JP | 2000-035279 | 2/2000 |
| JP | 2012-126057 | 7/2012 |
| JP | 2013-039697 | 2/2013 |

* cited by examiner

*Primary Examiner* — Daniel J Colilla
(74) *Attorney, Agent, or Firm* — Workman Nydegger

(57) ABSTRACT

A drying device includes: a supporting section that supports a medium on which printing was performed; a conveying section that conveys, along a conveying region, the medium supported by the supporting section; a heat generating section configured to heat, over a width direction, the medium supported by the supporting section; a fix-supporting section configured to support the heat generating section fixing the heat generating section; and free-supporting section configured to support the heat generating section so that the heat generating section can expand and contract, wherein the fix-supporting section is located in a first lateral region that is a region outside the conveying region in the width direction, and the free-supporting section is located in a second lateral region that is a region outside the conveying region in the width direction and different from the first lateral region.

16 Claims, 3 Drawing Sheets

DRYING DEVICE AND PRINTING DEVICE

The present application is based on, and claims priority from JP Application Serial Number 2018-205450, filed Oct. 31, 2018, the disclosure of which is hereby incorporated by reference herein in its entirety.

BACKGROUND

The present disclosure relates to a drying device that dries a medium on which printing was performed and a printing device that performs printing on a medium.

As disclosed in, for example, JP-A-2013-39697, there is an infrared heater that is one example of a drying device that heats and dries a recording medium that is one example of a medium with an infrared radiation section that is one example of a heat generating section. The infrared heater heats the recording medium over the width direction with the infrared radiation section, which is long in the width direction.

SUMMARY

The infrared radiation section may expand with heat. The longer the length of the infrared radiation section, the more the amount of expansion of the infrared radiation section increases, so that the infrared radiation section is likely to deform.

Such a problem is not limited to the infrared heater including the infrared radiation section, and there is a risk that the problem occurs also in a drying device and a printing device that include a heat generating section.

A drying device according to one embodiment, includes: a supporting section configured to support a medium on which printing was performed; a conveying section configured to convey, along a conveying region, the medium supported by the supporting section; a heat generating section configured to heat, over a width direction, the medium supported by the supporting section; a fix-supporting section configured to support the heat generating section fixing the heat generating section; and a free-supporting section configured to support the heat generating section so that the heat generating section can expand and contract, wherein the fix-supporting section is located in a first lateral region that is a region outside the conveying region in the width direction, and the free-supporting section is located in a second lateral region that is a region outside the conveying region in the width direction and that is a region different from the first lateral region.

In another embodiment, a printing device includes: a printing section configured to perform printing on a medium; a supporting section configured to support the medium on which printing was performed; a conveying section configured to convey, along a conveying region, the medium supported by the supporting section; a heat generating section configured to heat, over a width direction, the medium supported by the supporting section; a fix-supporting section configured to support the heat generating section fixing the heat generating section; and a free-supporting section configured to support the heat generating section so that the heat generating section can expand and contract, wherein the fix-supporting section is located in a first lateral region that is a region outside the conveying region in the width direction, and the free-supporting section is located in a second lateral region that is a region outside the conveying region in the width direction and that is a region different from the first lateral region.

DESCRIPTION OF EXEMPLARY EMBODIMENTS

Hereinafter, one embodiment of a drying device and a printing device will be described with reference to the drawings. The printing device is, for example, an inkjet-type printer that prints a letter or an image such as a photograph onto a medium such as a sheet of paper by ejecting ink that is one example of a liquid.

Figure 1:
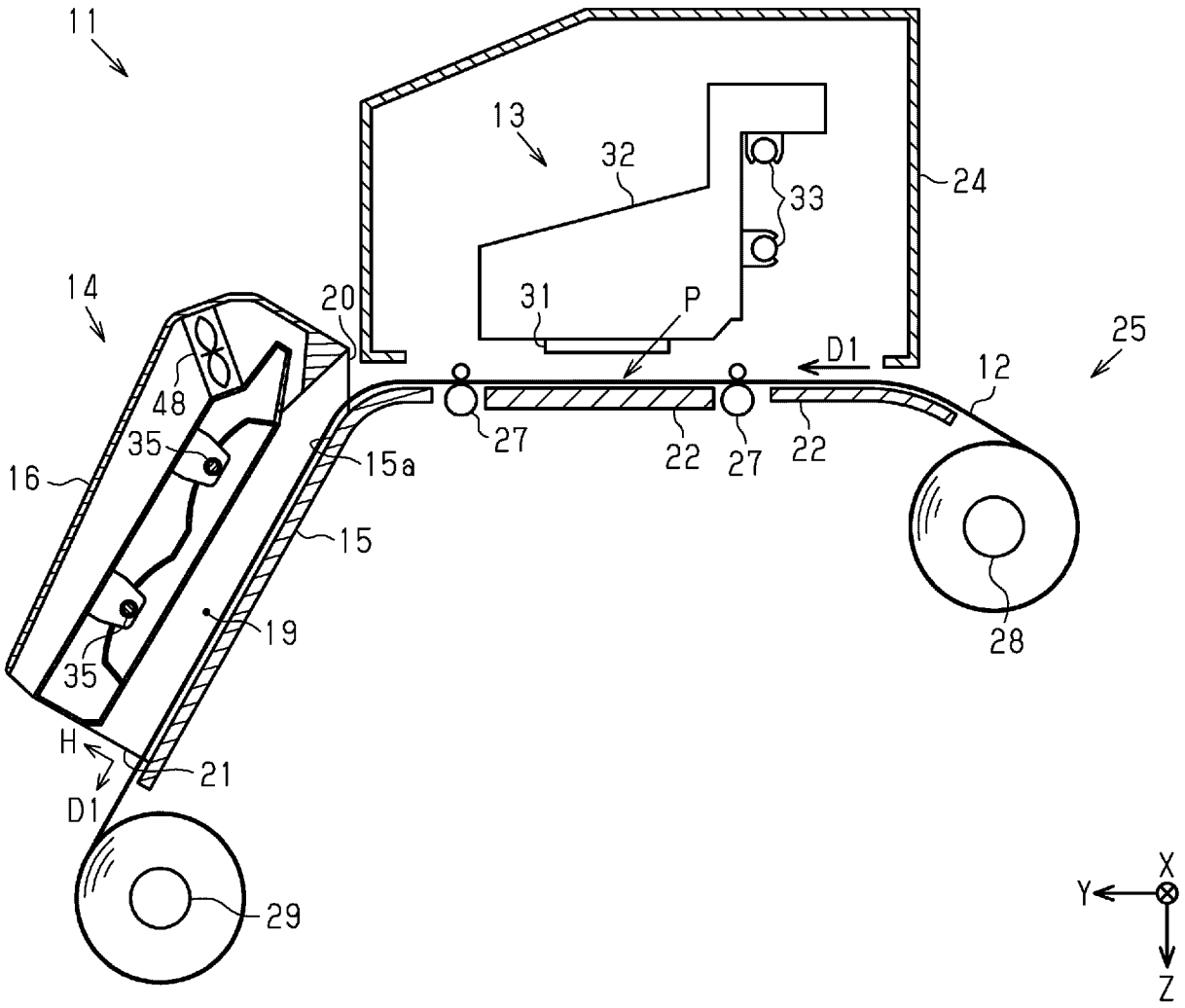
FIG. 1 is a schematic cross-sectional view showing one embodiment of a printing device.

As shown in FIG. 1, a printing device 11 includes a printing section 13 that performs printing on a medium 12 and a drying device 14 that dries the medium 12 on which printing was performed. The drying device 14 includes a supporting section 15 including a supporting surface 15*a* that supports the medium 12 on which printing was performed, and a heat generating device 16 that heats the medium 12 supported by the supporting section 15.

The drying device 14 includes a drying chamber 19 that is a space for drying the medium 12 supported by the supporting section 15. The drying chamber 19 includes a carry-in section 20 in which the medium 12 on which printing was performed is carried and a carry-out section 21 out of which the dried medium 12 is carried. The carry-in section 20 and the carry-out section 21 are openings formed of the supporting section 15 and the heat generating device 16. The supporting section 15 and the heat generating device 16 may form the carry-in section 20 and the carry-out section 21 in a state in which the supporting section 15 and the heat generating device 16 are separated from each other.

In the drawing, the direction of gravity is represented by the Z-axis with the printing device 11 assumed to be placed on a horizontal plane, and directions along a plane crossing the Z-axis are represented by the X-axis and the Y-axis. When the X-axis, the Y-axis, and the Z-axis are orthogonal to each other, the X-axis and the Y-axis are along the horizontal plane. In the following description, the X-axis direction is also referred to as "width direction X" of the medium 12, the Y-axis direction is also referred to as "horizontal direction Y", and the Z-axis direction is also referred to as "vertical direction Z". In directions along the supporting surface 15*a*, the direction in which the medium 12 is conveyed is also referred to as "conveying direction D1", and the direction perpendicular to the supporting surface 15*a* is also referred to as "normal direction H". The conveying direction D1 and the normal direction H are orthogonal to the X-axis.

The printing device 11 may include a guide section 22 that guides the medium 12 to the drying device 14. The guide section 22 guides the medium 12 on which printing is performed by the printing section 13 or the medium 12 before performing printing. In the drawing, the medium 12 is illustrated separately from the supporting section 15 and the guide section 22; however, the medium 12 is conveyed in a state of being in contact with the supporting section 15 and the guide section 22 and supported so as to slide thereon.

The printing device 11 may include a housing body 24 that houses the printing section 13. The printing device 11 includes a conveying section 25 that conveys the medium 12 in the conveying direction D1. The conveying section 25 may include a conveying roller 27 that conveys the medium 12, a feeding shaft 28 located upstream from the conveying roller 27 in the conveying direction D1, and a winding shaft 29 located downstream from the conveying roller 27 in the conveying direction D1. When the conveying section 25 includes the conveying roller 27, the conveying section 25 may include a plurality of the conveying rollers 27. The feeding shaft 28 and the winding shaft 29 rotatably support a roll obtained by winding the medium 12 having a long length into a cylindrical shape. The feeding shaft 28 feeds, while unwinding, the wound medium 12. The conveying roller 27 conveys the fed medium 12 along the guide section 22 and the supporting section 15. The winding shaft 29 winds the conveyed medium 12 therearound.

The printing section 13 may include a liquid ejection head 31 that ejects a liquid from a nozzle, a carriage 32 that holds the liquid ejection head 31, and guide shafts 33 that guide the movement of the carriage 32. The carriage 32 reciprocates in the width direction X along the guide shafts 33. The liquid ejection head 31 ejects, while moving together with the carriage 32, the liquid onto the medium 12 guided by the guide section 22. The liquid is deposited onto the medium 12, so that printing is performed on the medium 12.

The drying device 14 is provided downstream from the printing section 13 in the conveying direction D1. The supporting section 15 supports the medium 12 on which printing was performed and which is conveyed downstream in the conveying direction D1 from a printing position P at which printing is performed on the medium 12. The supporting section 15 is inclined with respect to the horizontal plane. That is, the supporting section 15 is disposed such that an upstream portion thereof in the conveying direction D1 is located higher than a downstream portion.

The medium 12 conveyed by the conveying section 25 passes through the drying chamber 19. In the drying chamber 19, the medium 12 on which printing was performed by the printing section 13 is heated by the heat generating device 16 and dried. The winding shaft 29 winds therearound the medium 12 that was dried by passing through the drying device 14.

Next, the drying device 14 will be described.

Figure 2:
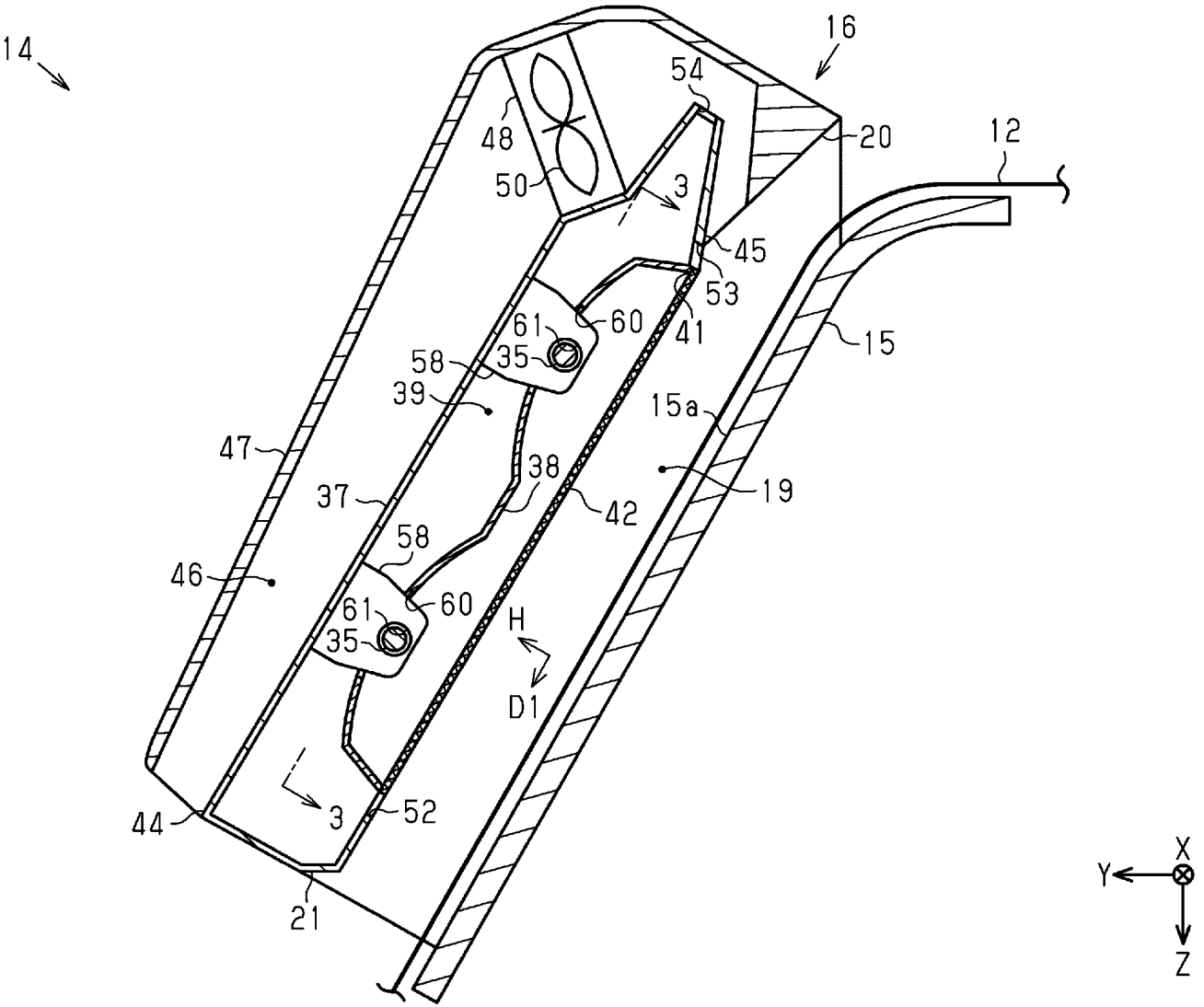
FIG. 2 is a schematic cross-sectional view of a drying device.

As shown in FIG. 2, the drying device 14 includes a heat generating section 35 that emits heat. The drying device 14 may include a plurality of the heat generating sections 35. When the plurality of heat generating sections 35 are provided such that intervals between the supporting section 15 and the plurality of heat generating sections 35 in the normal direction H are equal to each other, heating unevenness of the medium 12 is reduced. The heat generating section 35 may be, for example, a heater that radiates an infrared ray, or may be a heating wire that generates heat with an electric current fed thereto.

The drying device 14 may include a cover 37 that covers the heat generating section 35 and a reflector 38 that reflects, toward the supporting surface 15*a*, the infrared ray emitted by the heat generating section 35. When the reflector 38 reflects the infrared ray, the medium 12 can be efficiently heated. The reflector 38 forms a heating chamber 39 between the cover 37 and the reflector 38, and also forms the drying chamber 19 between the supporting section 15 and the reflector 38.

In the cover 37, an opening 41 facing the supporting section 15 or the medium 12 supported by the supporting section 15 may be formed. The drying device 14 may include a wire gauze 42 that covers the opening 41. In a configuration in which the wire gauze 42 is disposed at the opening 41, the heat of the heat generating section 35 is transferred to the medium 12 on the supporting surface 15*a* through the wire gauze 42.

The drying device 14 includes a channel member 47 that forms an air blowing passage 46 that connects an inflow port 44 with an outflow port 45, and an air blowing section 48 provided in the air blowing passage 46 between the inflow port 44 and the outflow port 45. The channel member 47 is provided outside the cover 37, and forms the air blowing passage 46 so as to surround the cover 37. Therefore, the heating chamber 39 is provided between the drying chamber 19 and the air blowing passage 46. The outflow port 45 is opened in the drying chamber 19. That is, the air blowing passage 46 connects the inflow port 44 with the drying chamber 19. The air blowing section 48 causes air to flow into the air blowing passage 46 via the inflow port 44. And the air blowing section 48 sends to the drying chamber 19 via the outflow port 45, the air flowing into the air blowing passage 46. The outflow port 45 is located between the heat generating section 35 and the carry-in section 20 in the conveying direction D1. A downstream portion of the air blowing passage 46 including the outflow port 45 extends so as to be inclined with respect to the supporting surface 15*a*. The air blowing section 48 includes a fan 50 that generates an air current, and causes air within the air blowing passage 46 to flow toward the outflow port 45. The air blowing section 48 sends the air flowing from the inflow port 44 into the air blowing passage 46 to the drying chamber 19. The air blowing section 48 causes air within the drying chamber 19 to flow from an upstream position to a downstream position in the conveying direction D1. Specifically, the air blowing section 48 blows air from a position upstream from the heat generating section 35 in the conveying direction D1 onto the medium 12 located downstream in the conveying direction D1. The air within the drying chamber 19 is discharged, together with the medium 12, from the carry-out section 21 located downstream from the heat generating section 35 in the conveying direction D1 to the outside of the drying device 14. In the embodiment, the air within the drying chamber 19 is discharged from the carry-out section 21 to the outside of the drying device 14; however, a configuration may be employed in which the air within the drying chamber 19 is discharged to the outside of the drying device 14 via an exhaust duct separately provided in the drying device 14.

An intake port 52, an exhaust port 53, and a communication port 54 are formed in the heating chamber 39. The intake port 52 and the exhaust port 53 communicate the drying chamber 19 with the heating chamber 39, and face the supporting section 15 or the medium 12 supported by the supporting section 15. The communication port 54 communicates the air blowing passage 46 between the air blowing section 48 and the outflow port 45 with the heating chamber 39.

The intake port 52 is located at a position downstream from the outflow port 45 in the conveying direction D1 and between the heat generating section 35 and the carry-out section 21 in the conveying direction D1. The exhaust port 53 is located at a position downstream from the outflow port 45 in the conveying direction D1 and between the heat generating section 35 and the carry-in section 20 in the conveying direction D1. The exhaust port 53 is located higher than the intake port 52 in the vertical direction Z. The communication port 54 is located higher than the exhaust port 53 in the vertical direction Z.

Figure 3:
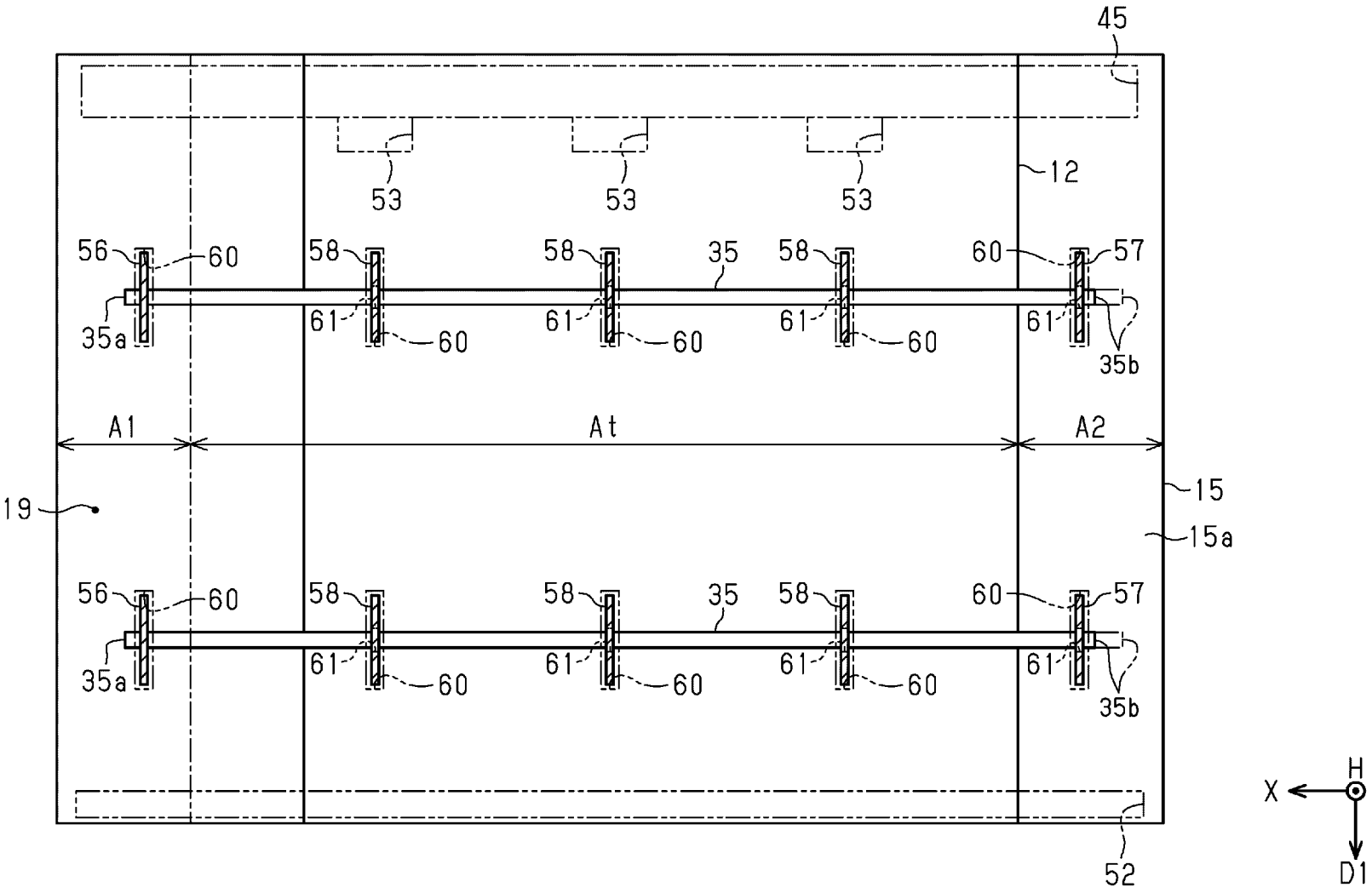
FIG. 3 is a cross-sectional view taken along arrows 3-3 in FIG. 2.

FIG. 3 illustrates a cross-sectional view taken along arrows 3-3 in FIG. 2, in which the cover 37, the reflector 38, the channel member 47, and the wire gauze 42 are omitted.

As shown in FIG. 3, the drying chamber 19 includes a conveying region At that is a region through which the medium 12 to be conveyed can pass, and a first lateral region A1 and a second lateral region A2 that are located at both sides of the conveying region At in the width direction X. The conveying section 25 conveys, along the conveying region At, the medium 12 supported by the supporting section 15. The first lateral region A1 and the second lateral region A2 different from the first lateral region A1 are regions through which the medium 12 does not pass.

The conveying region At is interposed between the first lateral region A1 located at one side and the second lateral region A2 located at the other side in the width direction X. That is, the conveying region At is adjacent to the first lateral region A1 at one side in the width direction X, and is adjacent to the second lateral region A2 at the other side. In directions parallel to the width direction X, the direction from the conveying region At toward the first lateral region A1 and the direction from the conveying region At toward the second lateral region A2 are opposite directions. The first lateral region A1 is located at the opposite side from the second lateral region A2 with respect to the conveying region At.

The width of the conveying region At, which is the size in the width direction X, is equal to or larger than the maximum width of the medium 12 conveyable by the conveying section 25. The conveying section 25 may convey the medium 12 that has a width narrower than that of the conveying region At. When the width of the medium 12 is narrower than the width of the conveying region At, the conveying section 25 conveys the medium 12 such that the medium 12 is brought near the second lateral region A2 in the conveying region At.

In the width direction X, the heat generating section 35 is larger than the conveying region At. Therefore, a first end 35*a* that is an end of the heat generating section 35 in the width direction X is located in the first lateral region A1, which is a region outside the conveying region At in the width direction X. A second end 35*b* at the opposite side from the first end 35*a* in the heat generating section 35 is located in the second lateral region A2, which is a region outside the conveying region At in the width direction X. The heat generating section 35 can heat, over the width direction X, the medium 12 supported by the supporting section 15.

As shown in FIGS. 2 and 3, the drying device 14 includes a fix-supporting section 56 and a free-supporting section 57. The fix-supporting section 56 supports the heat generating section 35, fixing the heat generating section. The free-supporting section 57 supports the heat generating section 35 so that the heat generating section 35 can expand and contract. The drying device 14 may include an intermediate supporting section 58 located between the fix-supporting section 56 and the free-supporting section 57 in the width direction X. The intermediate supporting section 58 supports the heat generating section 35 so that the heat generating section 35 can expand and contract. The drying device 14 may include a plurality of the intermediate supporting sections 58. The fix-supporting section 56 is located in the first lateral region A1. The free-supporting section 57 is located in the second lateral region A2. The intermediate supporting section 58 is located in the conveying region At. The fix-supporting section 56, the free-supporting section 57, and the intermediate supporting section 58 that support one heat generating section 35 are arranged in a line in the width direction X.

The base ends of the fix-supporting section 56, the free-supporting section 57, and the intermediate supporting section 58 are fixed to the cover 37, and the tips of the fix-supporting section 56, the free-supporting section 57, and the intermediate supporting section 58 are located in the drying chamber 19 via through-holes 60 formed in the reflector 38. The heat generating section 35 supported by the fix-supporting section 56, the free-supporting section 57, and the intermediate supporting section 58 is provided in the drying chamber 19.

The heat generating section 35 forms, for example, a columnar shape, and is provided such that the longitudinal direction of the heat generating section 35 coincides with the width direction X. Insertion holes 61 through which the heat generating section 35 is inserted are formed in the free-supporting section 57 and the intermediate supporting section 58. The insertion holes 61 penetrate the free-supporting section 57 and the intermediate supporting section 58 in the width direction X. The diameter of the insertion hole 61 is larger than the diameter of the heat generating section 35. The free-supporting section 57 and the intermediate supporting section 58 allow the expansion and contraction of the heat generating section 35 in the width direction X, and restrict the movement of the heat generating section 35 in directions different from the width direction X to a certain range. Specifically, the free-supporting section 57 and the intermediate supporting section 58 restrict the movement of the heat generating section 35 in the vertical direction Z, the normal direction H, and the horizontal direction Y.

The fix-supporting section 56, the free-supporting section 57, and the intermediate supporting section 58 are located between the outflow port 45 and the intake port 52 in the conveying direction D1. In the width direction X, the sizes of the outflow port 45 and the intake port 52 may be larger than the conveying region At or may be the same size as the conveying region At. In the drying device 14, a plurality of the outflow ports 45 that are smaller than the conveying region At in the width direction X may be formed. The exhaust port 53 is located between the intermediate supporting section 58 and the outflow port 45 in the conveying direction D1. The outflow port 45, the exhaust port 53, and the intermediate supporting section 58 are formed such that the positions thereof in the width direction X are aligned with each other. Specifically, at least a portion of the outflow port 45, at least a portion of the exhaust port 53, and at least a portion of the intermediate supporting section 58 are arranged in a line in the conveying direction D1. That is, at least a portion of the outflow port 45, at least a portion of the exhaust port 53, and at least a portion of the intermediate supporting section 58 are located in the same region in the width direction X.

Operation of the embodiment will be described.

As shown in FIG. 2, the drying chamber 19 and the heating chamber 39 are heated by the heat generating section 35. The air blowing section 48 causes air flowing from the inflow port 44 into the air blowing passage 46 and present therewithin to flow toward the outflow port 45. The air blowing section 48 blows the air from the outflow port 45 toward the medium 12 located downstream in the conveying direction D1.

The exhaust port 53 and the communication port 54 are located higher than the intake port 52 in the vertical direction Z. Therefore, warmed air within the heating chamber 39 is likely to flow toward the exhaust port 53 and the communication port 54. The communication port 54 is opened in the air blowing passage 46, and therefore, the air within the heating chamber 39 flows out of the communication port 54 into the air blowing passage 46 so as to be pulled by air flowing through the air blowing passage 46. The air flowing out of the communication port 54 into the air blowing passage 46 is the air heated in the heating chamber 39, and therefore has a temperature higher than that of air flowing from the inflow port 44. Hence, air in which the air flowing from the inflow port 44 is mixed with the air having a temperature higher than that of the air flowing from the inflow port 44 has a temperature higher than that of the air flowing from the inflow port 44.

The exhaust port 53 is located downstream from the outflow port 45 in the conveying direction D1. Therefore, the air within the heating chamber 39 flows out of the exhaust port 53 into the drying chamber 19 so as to be pulled by air flowing downstream in the conveying direction D1 from the outflow port 45. The air flowing out of the outflow port 45 is further increased in temperature when mixed with air flowing out of the exhaust port 53. Hence, the air having a temperature higher than that of the air flowing from the inflow port 44 can be blown onto the medium 12 located in the drying chamber 19.

In the width direction X, the temperature of air blown onto the medium 12 in a region in which the exhaust port 53 or the communication port 54 is located is likely to be higher than the temperature of air blown onto the medium 12 in a region in which the exhaust port 53 and the communication port 54 are absent. Especially in the conveying direction D1, the intermediate supporting section 58 blocks the heat emitted by the heat generating section 35 in a region located downstream of the exhaust port 53, and therefore, the medium 12 in a region in which the intermediate supporting section 58 is located in the width direction X is less likely to be heated. That is, air at a high temperature flows through a region in which the temperature is less likely to rise in the width direction X, and therefore, drying unevenness of the medium 12 can be reduced.

When the air within the heating chamber 39 flows out of the communication port 54 and the exhaust port 53, air flows from the intake port 52 into the heating chamber 39. The air flowing from the intake port 52 is air warmed by the heat generating section 35 in the drying chamber 19. Air circulates through the heating chamber 39, the air blowing passage 46, and the drying chamber 19.

The heat generating section 35 at a normal temperature represented by the solid line in FIG. 3 expands and contracts with the position at which the heat generating section 35 is fixed to the fix-supporting section 56 as a base point when the temperature of the heat generating section 35 changes. The amount of expansion and contraction of the heat generating section 35 caused by the change in temperature is proportional to the length of the heat generating section 35. The length of the heat generating section 35 in the width direction X is longer than the lengths thereof in the vertical direction Z, the conveying direction D1, and the normal direction H. Therefore, the heat generating section 35 expands and contracts more greatly in the width direction X than in the vertical direction Z, the conveying direction D1, and the normal direction H.

The fix-supporting section 56 fix-supporting the heat generating section 35 serves as a base point when the heat generating section 35 expands and contracts. The length of the heat generating section 35 in the width direction X from the first end 35*a* located in the first lateral region A1 to the fix-supporting section 56 is shorter than the length of the heat generating section 35 in the width direction X from the second end 35*b* located in the second lateral region A2 to the fix-supporting section 56. Therefore, the amount of movement of the first end 35*a* caused by the change in temperature of the heat generating section 35 is smaller than the amount of movement of the second end 35*b*.

As represented by the chain double-dashed line in FIG. 3, when the temperature of the heat generating section 35 rises, the heat generating section 35 extends in the width direction X such that the second end 35*b* moves away from the fix-supporting section 56. When the temperature of the heat generating section 35 decreases from the state represented by the chain double-dashed line in FIG. 3, the heat generating section 35 contracts in the width direction X such that the second end 35*b* moves toward the fix-supporting section 56.

Advantageous effects of the embodiment will be described.

(1) For example, when a plurality of points of the heat generating section 35 are fixed and supported, there is a risk that the extended heat generating section 35 curves between the plurality of fixed points. In that regard, the fix-supporting section 56 and the free-supporting section 57 support the heat generating section 35 at both sides of the conveying region At. The heat generating section 35 expands and contracts with the fix-supporting section 56 as a base point. The free-supporting section 57 supports the heat generating section 35 while allowing the expansion and contraction of the heat generating section 35. Hence, the risk of deformation of the heat generating section 35 can be reduced.

(2) In the medium 12 heated by the heat generating section 35, the temperature of the central portion is more likely to rise than that of the edge portion in the width direction X. In that regard, the conveying section 25 conveys the medium 12 such that the medium 12 is brought near the second lateral region A2 in which the free-supporting section 57 is located. The heat generating section 35 fixed by the fix-supporting section 56 located in the first lateral region A1 is lengthened at a portion located in the second lateral region A2 when the heat generating section 35 extends with an increase in temperature. Hence, the edge portion of the medium 12, the temperature of which is less likely to rise, can be easily heated.

(3) For example, when the medium 12 that has a wide width is conveyed, the interval between the fix-supporting section 56 and the free-supporting section 57, which are located at both sides of the conveying region At, is also widened. When the interval between the fix-supporting section 56 and the free-supporting section 57 is wide, there is a risk that the heat generating section 35 bends under its own weight. In that regard, the intermediate supporting section 58 supporting the heat generating section 35 between the fix-supporting section 56 and the free-supporting section 57 is included. The intermediate supporting section 58 allows the expansion and contraction of the heat generating section 35 and supports the heat generating section 35, and therefore, the risk of bending of the heat generating section 35 can be reduced.

(4) For example, when the temperature of air passing through the air blowing section 48 is high, the air blowing section 48 needs to be heat resistant. In that regard, the exhaust port 53 formed in the heating chamber 39 is located downstream from the outflow port 45 in the conveying direction D1. Therefore, when the air blowing section 48 blows air from the outflow port 45 onto the medium 12 located downstream from the outflow port 45 in the conveying direction D1, air is drawn from the exhaust port 53 and blown onto the medium 12. Hence, even when air at a high temperature is blown onto the medium 12, the temperature of air passing through the air blowing section 48 can be lowered.

(5) For example, when the temperature of air passing through the air blowing section 48 is high, the air blowing section 48 needs to be heat resistant. In that regard, the communication port 54 communicates the air blowing passage 46 between the air blowing section 48 and the outflow port 45 with the heating chamber 39. Therefore, when the air blowing section 48 sends air toward the outflow port 45, air within the heating chamber 39 is drawn to the air blowing passage 46 and sent from the outflow port 45 to the drying chamber 19. Hence, even when air at a high temperature is sent from the outflow port 45, the temperature of air passing through the air blowing section 48 can be lowered.

(6) The intake port 52, the exhaust port 53, and the communication port 54 are formed in the heating chamber 39. Therefore, for example compared to when any one of the exhaust port 53 and the communication port 54 is provided in the heating chamber 39, the temperature of air blown from the outflow port 45 onto the medium 12 can be made higher.

(7) The intermediate supporting section 58 supporting the heat generating section 35 blocks the heat emitted by the heat generating section 35, and prevents heating of the medium 12. Therefore, the medium 12 located between the intermediate supporting section 58 and the supporting section 15 is less likely to be heated. In that regard, the exhaust port 53 formed in the heating chamber 39 is located between the intermediate supporting section 58 and the outflow port 45. The air blowing section 48 sends air, from the outflow port 45, between the intermediate supporting section 58 and the supporting section 15 and toward the intermediate supporting section 58. Air within the heating chamber 39 is pulled by the air sent from the outflow port 45 by the air blowing section 48, and sent from the exhaust port 53 to the drying chamber 19. That is, air at a high temperature in which the air flowing out of the outflow port 45 is mixed with air warmed in the heating chamber 39 is sent between the intermediate supporting section 58 and the supporting section 15 and to the intermediate supporting section 58. By sending the air at a high temperature between the intermediate supporting section 58 and the supporting section 15, heating of the medium 12 located at a position at which the medium 12 is less likely to be heated can be supplemented. The higher the temperature of blown air is, the more likely the temperature of the intermediate supporting section 58 is to rise. The amount of infrared ray radiated from the intermediate supporting section 58 is larger as the temperature of the intermediate supporting section 58 is higher. Hence, by blowing air at a high temperature onto the intermediate supporting section 58, the amount of infrared ray emitted from the intermediate supporting section 58 is increased, and heating of the medium 12 can be supplemented. Hence, even when the intermediate supporting section 58 supports the heat generating section 35, temperature unevenness of the medium 12 can be reduced.

(8) When the reflector 38 reflecting the heat emitted by the heat generating section 35 is provided, there is a risk that the reflector 38 itself is also heated and the space behind the reflector 38 is heated to a high temperature. In that regard, the space behind the reflector 38 is used as the heating chamber 39, and the intake port 52, the exhaust port 53, and the communication port 54 are formed in the heating chamber 39 to cause air within the heating chamber 39 to flow. With this configuration, the risk of an excessive increase in temperature in the space behind the reflector 38 can be reduced.

(9) For example, when the plurality of heat generating sections 35 are arranged in the width direction X, the temperature is less likely to rise at a joint of the heat generating sections 35, so that there is the risk of occurrence of heating unevenness. In that regard, the heat generating section 35 heats the conveying region At over the width direction X, and therefore, the risk of occurrence of heating unevenness can be reduced.

(10) For example, when a plurality of points of the heat generating section 35 in the width direction X are fixed and supported by the fix-supporting sections 56, the heat generating section 35 that expanded with an increase in temperature is deformed so as to curve between the plurality of fix-supporting sections 56. When the heat generating section 35 is greatly deformed, there is the risk of breakage of the heat generating section 35; however, even when the heat generating section 35 is deformed to an extent that it does not cause the breakage, the distance in the normal direction H between the heat generating section 35 and the medium 12 changes. Specifically, for example when the heat generating section 35 fixed at both ends in the width direction X expands and curves such that the center moves toward the medium 12, the distance between the heat generating section 35 and the medium 12 at the center of the conveying region At is shorter than the distance between the heat generating section 35 and the medium 12 at the edge of the conveying region At. Therefore, in the conveying region At, the temperature at the central region is more likely to rise than that at the edge region, so that heating unevenness occurs. In the drying device 14 drying the medium 12 on which printing was performed, when heating unevenness occurs, there is the risk of a decrease in print quality. The longer the length of the heat generating section 35 in the width direction X is, the larger the amount of deformation of the heat generating section 35 is. Therefore, especially in the printing device 11 that performs printing on the medium 12 that has a large size with a large width, the deformation of the heat generating section 35 is likely to affect print quality. In that regard, the drying device 14 allows the expansion and contraction of the heat generating section 35 and supports the heat generating section 35 with the free-supporting section 57. Hence, the risk of change in distance between the medium 12 and the heat generating section 35 is reduced, and the risk of a decrease in print quality can be reduced.

(11) The heat generating section 35 is more likely to bend under its own weight as the interval at which the heat generating section 35 is supported in the width direction X becomes wider. That is, when the heat generating section 35 is supported by the fix-supporting section 56 and the free-supporting section 57, the heat generating section 35 is more likely to bend as the interval between the fix-supporting section 56 and the free-supporting section 57 becomes wider. The diameter of the insertion hole 61 formed in the free-supporting section 57 is larger than the diameter of the heat generating section 35. The free-supporting section 57 allows the expansion and contraction of the heat generating section 35 in the width direction X, and restricts the movement of the heat generating section 35 in the vertical direction Z to a certain range. Therefore, when the heat generating section 35 bends, the contact area of the heat generating section 35 and the free-supporting section 57 is narrowed, so that there is a risk that the free-supporting section 57 obstructs the expansion and contraction of the heat generating section 35. In that regard, the drying device 14 includes the intermediate supporting section 58, and the interval at which the heat generating section 35 is supported can be narrowed to reduce the bending of the heat generating section 35. Hence, in the drying device 14, the heat generating section 35 can be smoothly expanded and contracted.

The embodiment can be modified and implemented as follows. The embodiment and the modified examples described below can be implemented by combining them within a scope not technically conflicting with each other.

The conveying section 25 may convey the medium 12 such that the medium 12 is brought near the first lateral region A1 in the conveying region At. The heat generating section 35 expands and contracts with the fix-supporting section 56 located in the first lateral region A1 as a base point. Hence, even when the heat generating section 35 expands and contracts, the positional relationship between the end of the heat generating section 35 at the side at which the heat generating section 35 is fixed by the fix-supporting section 56 and the edge of the medium 12 can be easily maintained.

At least one of the intake port 52, the exhaust port 53, and the communication port 54 may not be formed in the heating chamber 39. That is, the intake port 52, the exhaust port 53, and the communication port 54 may not be formed in the heating chamber 39.

In the heating chamber 39, the intake port 52 and the exhaust port 53 may be formed, and the communication port 54 may not be formed. In the drying device 14, air may be circulated via the heating chamber 39, the exhaust port 53, the drying chamber 19, and the intake port 52.

In the heating chamber 39, the intake port 52 and the communication port 54 may be formed, and the exhaust port 53 may not be formed. In the drying device 14, air may be circulated via the heating chamber 39, the communication port 54, the air blowing passage 46, the drying chamber 19, and the intake port 52.

In the heating chamber 39, at least one of the exhaust port 53 and the communication port 54 may be formed, and the intake port 52 may not be formed. The intake port 52 may be formed so as to communicate the heating chamber 39 with the outside of the drying device 14.

The size of the through-hole 60 may be larger than that of the intermediate supporting section 58. That is, a gap may be provided between the through-hole 60 and the intermediate supporting section 58. The intermediate supporting section 58 blocks the heat emitted by the heat generating section 35, and therefore, the temperature in a region in which the intermediate supporting section 58 is located in the width direction X is less likely to rise compared to that in a region in which the intermediate supporting section 58 is not located. In that regard, when air within the drying chamber 19 is flowed into the heating chamber 39 via the through-hole 60, air flowing out of the outflow port 45 can be lead toward the through-hole 60. Therefore, the air in the region in which the intermediate supporting section 58 is located and the temperature is less likely to rise can be easily caused to flow, so that drying unevenness of the medium 12 can be reduced.

The communication port 54 may face the air blowing section 48. That is, the air blowing section 48 may cause air within the air blowing passage 46 to flow into the heating chamber 39 via the communication port 54. Air within the heating chamber 39 may be flowed to the drying chamber 19 via, for example, the through-hole 60. The through-hole 60 is located in the region in which the intermediate supporting section 58 is located and the temperature is less likely to rise. Therefore, when air heated in the heating chamber 39 is flowed out of the through-hole 60, drying unevenness of the medium 12 can be reduced.

The drying device 14 may include, separately from the reflector 38, a partition wall by which the drying chamber 19 and the heating chamber 39 are partitioned from each other.

The reflector 38 may be provided away from the cover 37. The drying device 14 may be configured without the reflector 38. That is, the drying device 14 may be configured such that the heating chamber 39 and the drying chamber 19 are not partitioned from each other. The drying device 14 may not include the drying chamber 19, and may heat the medium 12 in a space opened to the outside.

The channel member 47 may be, for example, a tubular duct. The air blowing passage 46 may be formed at a position away from the cover 37.

The drying device 14 may be provided separately from a printing device that performs printing on the medium 12.

The printing device 11 is a device that prints a letter or a picture, or an image such as a photograph by depositing a liquid such as ink onto the medium 12, and the printing device 11 may be a serial printer, a lateral type printer, a line printer, a page printer, or the like. Moreover, the printing device may be an offset printing device, a textile printing device, or the like.

Technical ideas grasped from the embodiment and modified examples described above and the operational effects thereof will be described below.

A drying device includes a supporting section configured to support a medium on which printing was performed; a conveying section configured to convey, along a conveying region, the medium supported by the supporting section; a heat generating section configured to heat, over a width direction, the medium supported by the supporting section; a fix-supporting section configured to support the heat generating section fixing the heat generating section; and a free-supporting section configured to support the heat generating section so that the heat generating section can expand and contract, wherein the fix-supporting section is located in a first lateral region that is a region outside the conveying region in the width direction, and the free-supporting section is located in a second lateral region that is a region outside the conveying region in the width direction and that is a region different from the first lateral region.

For example, when a plurality of points of the heat generating section are fixed and supported, there is a risk that the extended heat generating section curves between the plurality of fixed points. In that regard, the fix-supporting section and the free-supporting section support the heat generating section at both sides of the conveying region. The heat generating section expands and contracts with the fix-supporting section as a base point. The free-supporting section supports the heat generating section while allowing the expansion and contraction of the heat generating section. Hence, the risk of deformation of the heat generating section can be reduced.

The conveying section may convey the medium brought near the second lateral region within the conveying region.

In the medium heated by the heat generating section, the temperature at the central portion is more likely to rise than that at the edge portion in the width direction. In that regard, the conveying section conveys the medium such that the medium is brought near the second lateral region in which the free-supporting section is located. The heat generating section fixed by the fix-supporting section located in the first lateral region is lengthened at a portion located in the second lateral region when the heat generating section extends with an increase in temperature. Hence, the edge portion of the medium, the temperature of which is less likely to rise, can be easily heated.

The conveying section may convey the medium brought near the first lateral region within the conveying region.

The conveying section conveys the medium such that the medium is brought near the first lateral region in which the fix-supporting section is located. The heat generating section expands and contracts with the fix-supporting section located in the first lateral region as a base point. Hence, even when the heat generating section expands and contracts, the positional relationship between the end of the heat generating section at the side at which the heat generating section is fixed by the fix-supporting section and the edge of the medium can be easily maintained.

The drying device may include an intermediate supporting section, that is located between the fix-supporting section and the free-supporting section in the width direction, configured to support the heat generating section so that the heat generating section can expand and contract.

For example, when the medium that has a wide width is conveyed, the interval between the fix-supporting section and the free-supporting section, which are located at both sides of the conveying region, is also widened. When the interval between the fix-supporting section and the free-supporting section is wide, there is a risk that the heat generating section bends under its own weight. In that regard, the intermediate supporting section supporting the heat generating section between the fix-supporting section and the free-supporting section is included. The intermediate supporting section allows the expansion and contraction of the heat generating section and supports the heat generating section, and therefore, the risk of bending of the heat generating section can be reduced.

The drying device may include a drying chamber configured to dry the medium supported by the supporting section; a channel member that forms an air blowing passage that connects an inflow port with an outflow port; a heating chamber provided between the drying chamber and the air blowing passage; and an air blowing section configured to cause air to flow into the air blowing passage via the inflow port and to send, to the drying chamber via the outflow port, the air flowing into the air blowing passage, wherein an intake port and an exhaust port may be formed in the heating chamber, and the exhaust port may be located downstream from the outflow port in a conveying direction of the medium.

For example, when the temperature of air passing through the air blowing section is high, the air blowing section needs to be heat resistant. In that regard, the exhaust port formed in the heating chamber is located downstream from the outflow port in the conveying direction. Therefore, when the air blowing section blows air from the outflow port onto the medium located downstream from the outflow port in the conveying direction, air is drawn from the exhaust port and blown onto the medium. Hence, even when air at a high temperature is blown onto the medium, the temperature of air passing through the air blowing section can be lowered.

The drying device may include a drying chamber configured to dry the medium supported by the supporting section; a channel member that forms an air blowing passage that connects an inflow port with an outflow port; a heating chamber provided between the drying chamber and the air blowing passage; and an air blowing section configured to cause air to flow int the air blowing passage via the inflow port and to send, to the drying chamber via the outflow port, the air caused to flow into the air blowing passage, wherein an intake port and a communication port are formed in the heating chamber, and the air blowing passage between the air blowing section and the outflow port communicates with the heating chamber via the communication port.

For example, when the temperature of air passing through the air blowing section is high, the air blowing section needs to be heat resistant. In that regard, the communication port communicates the air blowing passage between the air blowing section and the outflow port with the heating chamber. Therefore, when the air blowing section sends air toward the outflow port, air within the heating chamber is drawn to the air blowing passage and sent from the outflow port to the drying chamber. Hence, even when air at a high temperature is sent from the outflow port, the temperature of air passing through the air blowing section can be lowered.

A communication port may be formed in the heating chamber, and the air blowing passage between the air blowing section and the outflow port communicates with the heating chamber via the communication port.

The intake port, the exhaust port, and the communication port are formed in the heating chamber. Therefore, for example compared to when any one of the exhaust port and the communication port is provided in the heating chamber, the temperature of air blown from the outflow port onto the medium can be made higher.

What is claimed is:

1. A drying device comprising:

a supporting section configured to support a medium on which printing was performed;

a conveying section configured to convey, along a conveying region, the medium supported by the supporting section;

a heat generating section configured to heat, over a width direction, the medium supported by the supporting section;

a fix-supporting section configured to support the heat generating section fixing the heat generating section;

a free-supporting section configured to support the heat generating section so that the heat generating section can expand and contract, a drying chamber configured to dry the medium supported by the supporting section;

a channel member that forms an air blowing passage that connects an inflow port with an outflow port;

a heating chamber provided between the drying chamber and the air blowing passage; and an air blowing section configured to cause air to flow into the air blowing passage via the inflow port and to send, to the drying chamber via the outflow port, the air flowing into the air blowing passage, wherein the fix-supporting section is located in a first lateral region that is a region outside the conveying region in the width direction, the free-supporting section is located in a second lateral region that is a region outside the conveying region in the width direction and that is a region different from the first lateral region, and at least one of an exhaust port, which is located downstream from the outflow port in a conveying direction of the medium, and a communication port, via which the air blowing passage between the air blowing section and the outflow port communicate with the heating chamber, is formed in the heating chamber.

2. The drying device according to claim 1, wherein the conveying section conveys the medium within the conveying region so that it is brought near the second lateral region.

3. The drying device according to claim 1, wherein
the conveying section conveys the medium within the conveying region so that it is brought near the first lateral region.

4. The drying device according to claim 1, further comprising an intermediate supporting section, that is located between the fix-supporting section and the free-supporting section in the width direction, configured to support the heat generating section so that the heat generating section can expand and contract.

5. The drying device according to claim 4, wherein
the outflow port, the exhaust port, and the intermediate supporting section are formed such that the positions thereof in the width direction are aligned with each other.

6. A printing device comprising:
a printing section configured to perform printing on a medium;
a supporting section configured to support the medium on which printing was performed;
a conveying section configured to convey, along a conveying region, the medium supported by the supporting section;
a heat generating section configured to heat, over a width direction, the medium supported by the supporting section;
a fix-supporting section configured to support the heat generating section fixing the heat generating section;
a free-supporting section configured to support the heat generating section so that the heat generating section can expand and contract,
a drying chamber configured to dry the medium supported by the supporting section;
a channel member that forms an air blowing passage that connects an inflow port with an outflow port;
a heating chamber provided between the drying chamber and the air blowing passage; and
an air blowing section configured to cause air to flow into the air blowing passage via the inflow port and to send, to the drying chamber via the outflow port, the air flowing into the air blowing passage, wherein
the fix-supporting section is located in a first lateral region that is a region outside the conveying region in the width direction,
the free-supporting section is located in a second lateral region that is a region outside the conveying region in the width direction and that is a region different from the first lateral region; and
at least one of an exhaust port, which is located downstream from the outflow port in a conveying direction of the medium, and a communication port, via which the air blowing passage between the air blowing section and the outflow port communicate with the heating chamber, is formed in the heating chamber.

7. The drying device according to claim 1, further comprising an intake port formed in the heating chamber.

8. The printing device according to claim 6, wherein
the conveying section conveys the medium within the conveying region so that it is brought near the second lateral region.

9. The printing device according to claim 6, wherein
the conveying section conveys the medium within the conveying region so that it is brought near the first lateral region.

10. The printing device according to claim 6, further comprising an intermediate supporting section, that is located between the fix-supporting section and the free-supporting section in the width direction, configured to support the heat generating section so that the heat generating section can expand and contract.

11. The printing device according to claim 10, wherein
the outflow port, the exhaust port, and the intermediate supporting section are formed such that the positions thereof in the width direction are aligned with each other.

12. The printing device according to claim 6, further comprising an intake port formed in the heating chamber.

13. A printing device comprising:
a printing section configured to perform printing on a medium;
a supporting section configured to support the medium on which printing was performed;
a conveying section configured to convey, along a conveying region, the medium supported by the supporting section;
a heat generating section configured to heat, over a width direction, the medium supported by the supporting section;
a drying chamber configured to dry the medium supported by the supporting section;
a channel member that forms an air blowing passage that connects an inflow port with an outflow port;
a heating chamber provided between the drying chamber and the air blowing passage; and
an air blowing section configured to cause air to flow into the air blowing passage via the inflow port and to send, to the drying chamber via the outflow port, the air flowing into the air blowing passage, wherein
at least one of an exhaust port, which is located downstream from the outflow port in a conveying direction of the medium, and a communication port, via which the air blowing passage between the air blowing section and the outflow port communicates with the heating chamber, is formed in the heating chamber.

14. The printing device according to claim 13, further comprising;
a first heater supporting section, that is located in one side in the width direction, configured to support the heat generating section;
a second heater supporting section, that is located in the other side in the width direction, configured to support the heat generating section; and
an intermediate supporting section, that is located between the first heater supporting section and the second heater supporting section in the width direction, configured to support the heat generating section.

15. The printing device according to claim 14, wherein
the outflow port, the exhaust port, and the intermediate supporting section are formed such that the positions thereof in the width direction are aligned with each other.

16. The printing device according to claim 13, further comprising an intake port formed in the heating chamber.

* * * * *